US006216624B1

(12) United States Patent
Page

(10) Patent No.: US 6,216,624 B1
(45) Date of Patent: Apr. 17, 2001

(54) DRAG FIN BRAKING SYSTEM

(76) Inventor: James F. Page, 45 Betts Ave., Lawrenceville, NJ (US) 08648

( * ) Notice: Subject to any disclaimer, the term of this patent is extended or adjusted under 35 U.S.C. 154(b) by 0 days.

(21) Appl. No.: 09/271,848

(22) Filed: Mar. 18, 1999

(51) Int. Cl.[7] ..... B63H 25/44; B63H 25/48
(52) U.S. Cl. ..... 114/145 R; 114/55.5
(58) Field of Search ..... 114/55.5, 145 R, 114/145 A

(56) References Cited

U.S. PATENT DOCUMENTS 3,756,189 * 9/1973 Yutzler ..... 114/55.5
3,964,417 * 6/1976 Williams et al. ..... 114/274
5,092,260 * 3/1992 Mardikian ..... 114/285
5,697,317 * 12/1997 Pereira ..... 114/55.52
5,813,357 * 9/1998 Watson ..... 114/145 R
5,970,898 * 10/1999 Pereira ..... 114/55.5

* cited by examiner

*Primary Examiner*—S. Joseph Morano
*Assistant Examiner*—Andrew Wright

(57) ABSTRACT

A jet ski braking system is provided including a jet ski having a bottom surface and a top control console including a steering mechanism, a seat and a pair of laterally spaced wells for placing feet of a rider. Also included is at least one pedal hingably coupled to the jet ski within one of the wells adjacent to the steering mechanism thereof. At least one brake flap is hingably mounted to the bottom surface of the jet ski. A connector assembly is included for lowering the brake flap upon the depression of the pedal.

5 Claims, 3 Drawing Sheets

FIG.1
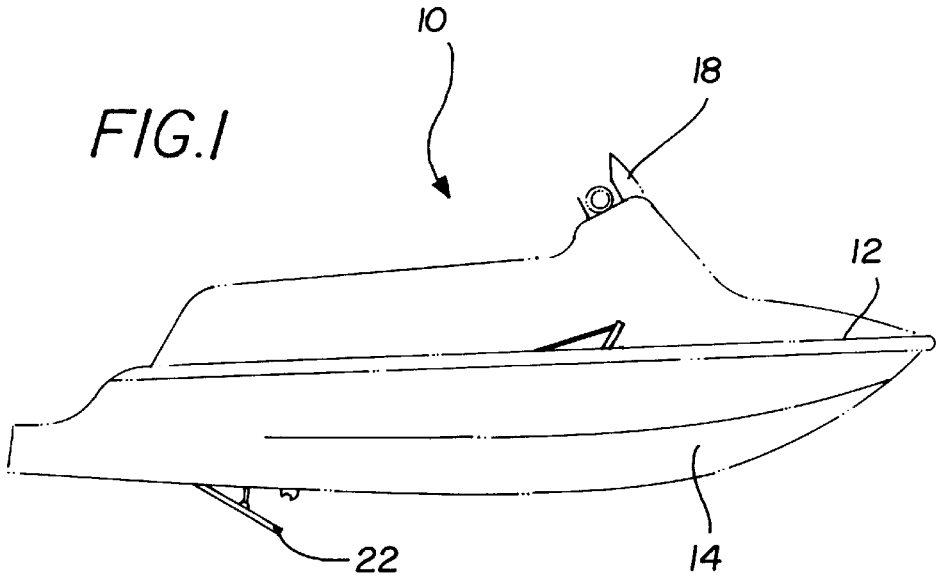
FIG.2
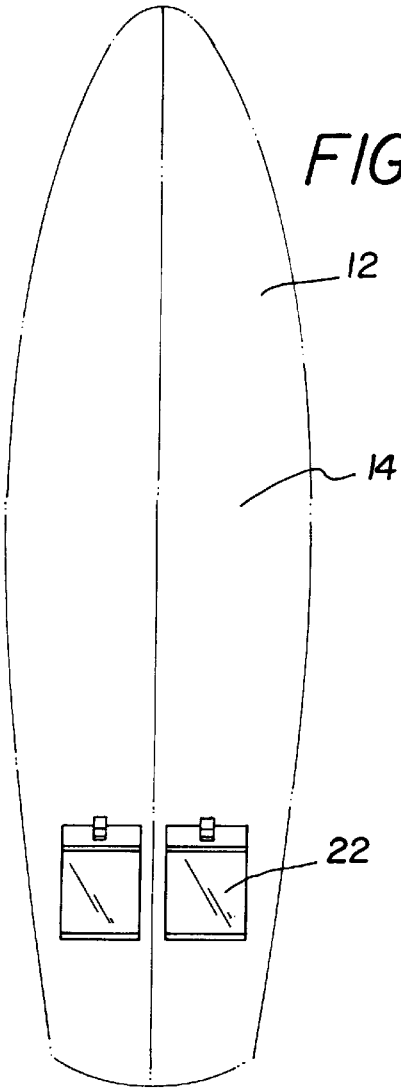
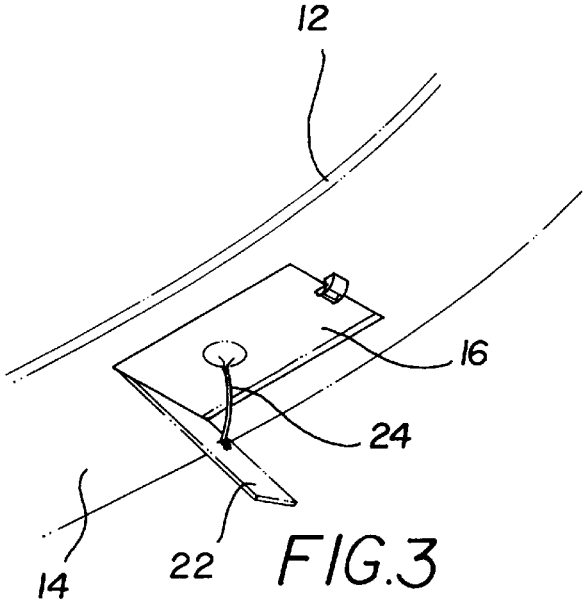
FIG.3

FIG.7
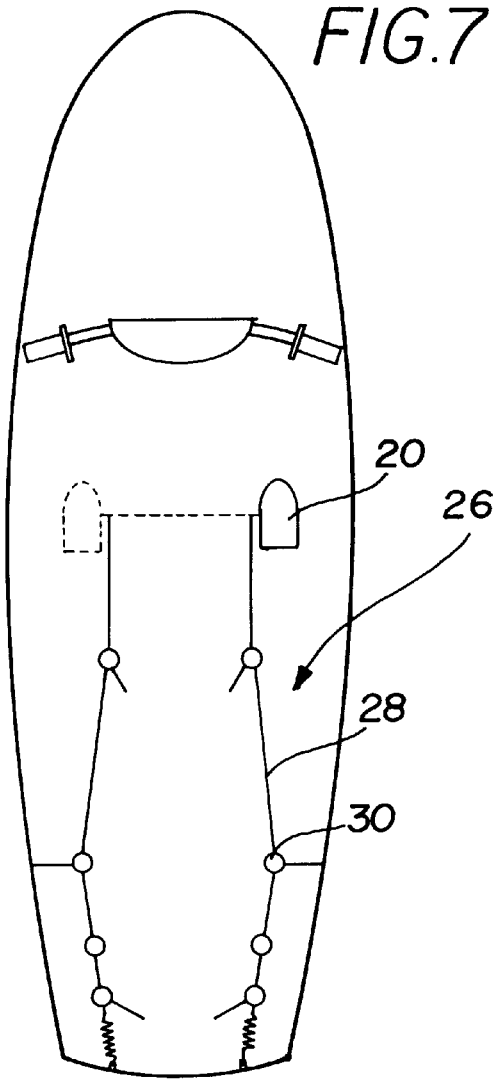
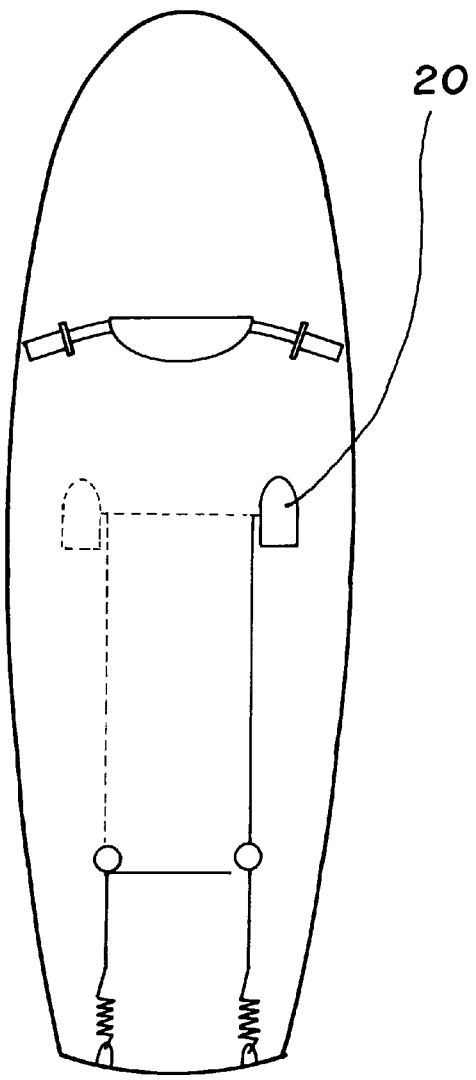
FIG.8

DRAG FIN BRAKING SYSTEM

BACKGROUND OF THE INVENTION

1. Field of the Invention

The present invention relates to jet ski braking systems and more particularly pertains to a new drag fin braking system for effectively slowing a jet ski within a body of water.

2. Description of the Prior Art

The use of jet ski braking systems is known in the prior art. More specifically, jet ski braking systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,193,478; 5,092,260; 2,864,330; 2,807,228; 5,755,601; and U.S. Pat. No. Des. 292,392.

In these respects, the drag fin braking system according to the present invention substantially departs from the conventional concepts and designs of the prior art, and in so doing provides an apparatus primarily developed for the purpose of effectively slowing a jet ski within a body of water.

SUMMARY OF THE INVENTION

In view of the foregoing disadvantages inherent in the known types of jet ski braking systems now present in the prior art, the present invention provides a new drag fin braking system construction wherein the same can be utilized for effectively slowing a jet ski within a body of water.

The general purpose of the present invention, which will be described subsequently in greater detail, is to provide a new drag fin braking system apparatus and method which has many of the advantages of the jet ski braking systems mentioned heretofore and many novel features that result in a new drag fin braking system which is not anticipated, rendered obvious, suggested, or even implied by any of the prior art jet ski braking systems, either alone or in any combination thereof.

To attain this, the present invention generally comprises a jet ski having a bottom surface with a pair of substantially planar rectangular recesses formed therein adjacent to a rear extent thereof. Associated therewith is a top control console including a steering mechanism, a seat and a pair of laterally spaced wells for placing feet of a rider. Also included is a pair of pedals each with a substantially planar rectangular configuration having a roughened top face, a bottom face and a periphery including a rear edge hingably coupled to the jet ski. Ideally each pedal is positioned within one of the wells adjacent to the steering mechanism thereof. Associated therewith is a pair of brake flaps each with a substantially planar rectangular configuration including a top face, a bottom face and a periphery. As shown in FIGS. 2 & 3, the flaps each have a rear edge hingably coupled within one of the recesses of the bottom surface of the jet ski. Each brake flap further includes an arcuate connector rod having a bottom end coupled to the top face of the brake flap and extending upwardly through a sliding aperture formed in the recess of the bottom surface of the jet ski. Finally, an interconnect assembly is provided including a pair of cables each having a first end coupled to the bottom face of one of the pedals and slidably positioned through a sliding hole formed therebelow. A second end of the cable is coupled to a spring which is in turn connected to the rear extent of the jet ski. The cable is further connected to a top end of the arcuate connector rod of one of the brake flaps, as shown in FIGS. 6 & 7. The spring thus functions to urge the associated brake flap upwards into the corresponding recess and the pedal is adapted for lowering the associated flap upon the depression thereof.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new drag fin braking system apparatus and method which has many of the advantages of the jet ski braking systems mentioned heretofore and many novel features that result in a new drag fin braking system which is not anticipated, rendered obvious, suggested, or even implied by any of the prior art jet ski braking systems, either alone or in any combination thereof.

It is another object of the present invention to provide a new drag fin braking system which may be easily and efficiently manufactured and marketed.

It is a further object of the present invention to provide a new drag fin braking system which is of a durable and reliable construction.

An even further object of the present invention is to provide a new drag fin braking system which is susceptible of a low cost of manufacture with regard to both materials and labor, and which accordingly is then susceptible of low prices of sale to the consuming public, thereby making such drag fin braking system economically available to the buying public.

Still yet another object of the present invention is to provide a new drag fin braking system which provides in the apparatuses and methods of the prior art some of the advantages thereof, while simultaneously overcoming some of the disadvantages normally associated therewith.

Still another object of the present invention is to provide a new drag fin braking system for effectively slowing a jet ski within a body of water.

Even still another object of the present invention is to provide a new drag fin braking system that includes a jet ski braking system with a jet ski having a bottom surface and a top control console including a steering mechanism, a seat and a pair of laterally spaced wells for placing feet of a rider. Also included is at least one pedal hingably coupled to the jet ski within one of the wells adjacent to the steering mechanism thereof. At least one brake flap is hingably mounted to the bottom surface of the jet ski. A connector assembly is included for lowering the brake flap upon the depression of the pedal.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side view of a new drag fin braking system according to the present invention.

FIG. 2 is a bottom view of the present invention.

FIG. 3 is a bottom perspective view of the brake flaps of the present invention.

FIG. 7 is a top view of the connector assembly of the first embodiment of the present invention.

FIG. 8 is a side view of the connector assembly of a second embodiment of the present invention.

DESCRIPTION OF THE PREFERRED EMBODIMENT

Figure 4:
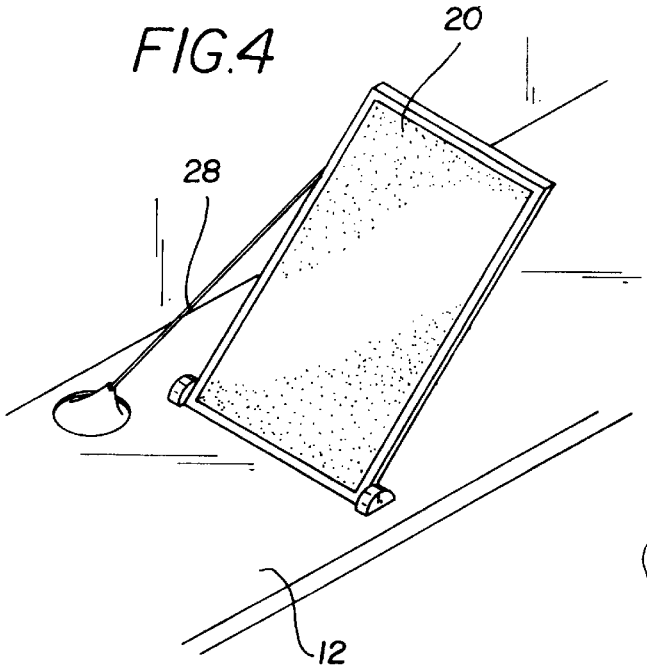
FIG. 4 is a top rear perspective view of one of the brake pedals of present invention.
Figure 5:
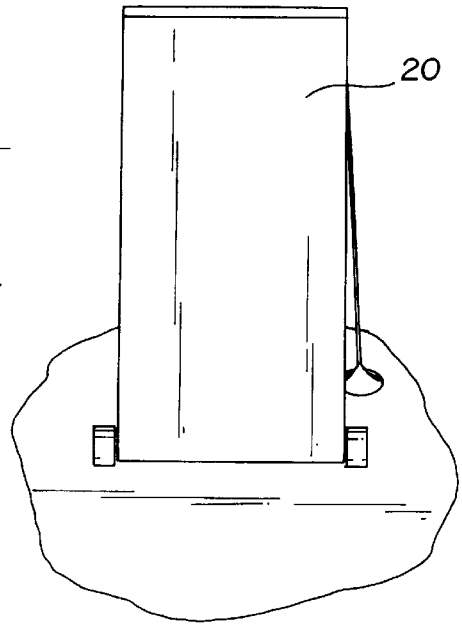
FIG. 5 is a top front perspective view of one of the brake pedals of the present invention.

With reference now to the drawings, and in particular to FIGS. 1 through 8 thereof, a new drag fin braking system embodying the principles and concepts of the present invention and generally designated by the reference numeral 10 will be described.

The present invention, designated as numeral 10, includes a jet ski 12 having a bottom surface 14 with a pair of substantially planar rectangular recesses 16 formed therein adjacent to a rear extent thereof. Associated therewith is a top control console 18 including a steering mechanism, a seat and a pair of laterally spaced wells for placing feet of a rider.

Also included is a pair of pedals 20 each with a substantially planar rectangular configuration having a roughened top face, a bottom face and a periphery including a rear edge hingably coupled to the jet ski. Ideally, each pedal is positioned within one of the wells adjacent to the steering mechanism thereof.

Associated therewith is a pair of brake flaps 22 each with a substantially planar rectangular configuration including a top face, a bottom face and a periphery. As shown in FIGS. 2 & 3, the flaps each have a rear edge hingably coupled within one of the recesses of the bottom surface of the jet ski. Each brake flap further includes an arcuate connector rod 24 having a bottom end coupled to the top face of the brake flap and extending upwardly through a sliding aperture formed in the recess of the bottom surface of the jet ski.

Figure 6:
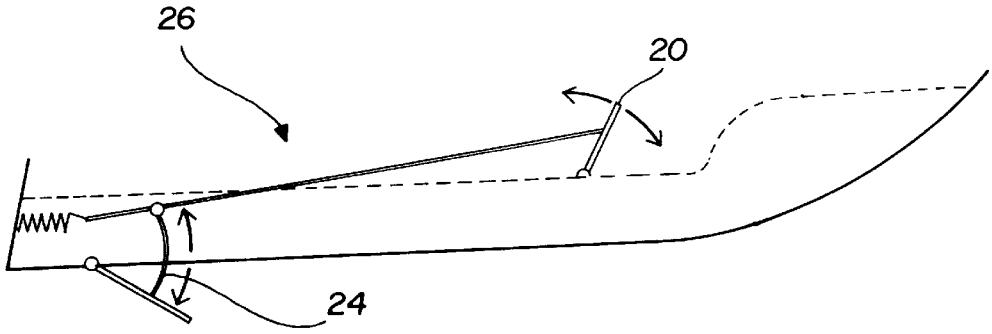
FIG. 6 is a side view of the connector assembly of a first embodiment of the present invention.

Finally, a corrosion-proof interconnect assembly 26 is provided including a pair of cables 28 each having a first end coupled to the bottom face of one of the pedals and slidably positioned through a sliding hole formed therebelow. In the preferred embodiment, the sliding aperture and hole each have an associated grommet. A second end of each cable is coupled to a spring which is in turn connected to the rear extent of the jet ski. Each cable is further connected to a top end of the arcuate connector rod of one of the brake flaps, as shown in FIGS. 6 & 7. As shown in FIG. 7, a plurality of O-ring guides 30 may be strategically positioned within channels formed in the interior of the jet ski for guiding the cable appropriately between the pedals and the flaps. The spring thus functions to urge the associated brake flap upwards into the corresponding recess and the pedal is adapted for lowering the associated flap upon the depression thereof.

It should be noted that any other type of interconnect assembly may be employed for effecting the foregoing operation. For example, a connector rod may be employed like that shown in FIG. 8. The type of interconnect assembly that is used depends on the type of engine configuration with which the jet ski is equipped. As yet another option, the brake flaps may be controlled together with a single pedal. Still yet another option includes the employment of a clasp positioned on a front edge of each of the recesses on the bottom surface of the jet ski. Such clasp is adapted to frictionally engage the front edge of the associated brake flap to prevent the inadvertent lowering thereof.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A jet ski braking system comprising, in combination:

a jet ski including a bottom surface with a pair of substantially planar rectangular recesses formed therein adjacent to a rear extent thereof and a top control console including a steering mechanism, a seat and a pair of laterally spaced wells for placing feet of a rider;

a pair of pedals each with a substantially planar rectangular configuration having a roughened top face, a bottom face and a periphery including a rear edge hingably coupled to the jet ski within one of the wells adjacent to the steering mechanism thereof;

a pair of brake flaps each with a substantially planar rectangular configuration including a top face, a bottom face and a periphery having a rear edge hingably coupled within one of the recesses of the bottom surface of the jet ski, each brake flap further including an arcuate connector rod having a bottom end coupled to the top face of the brake flap and extending upwardly through a sliding aperture formed in the recess of the bottom surface of the jet ski; and an interconnect assembly including a pair of cables each having a first end coupled to the bottom face of one of the pedals and slidably positioned through a sliding hole formed therebelow and a second end coupled to a spring which is in turn connected to the rear extent of the jet ski, wherein the cable is further connected to a top end of the arcuate connector rod of one of the brake flaps for lowering the same upon the depression of the associated pedal.

2. A jet ski braking system comprising:

a jet ski including a bottom surface with a pair of recesses formed in the bottom surface adjacent to a rear extent of the jet ski and a top control console including a steering mechanism, a seat and a pair of laterally spaced wells for placing feet of a rider;

a pair of pedals each having at top face and a rear edge hingably coupled to the jet ski;

a pair of brake flaps each having a rear edge hingably coupled to the bottom surface of the jet ski, each brake flap further including a connector rod having a bottom end coupled to the top face of the brake flap; and an interconnect assembly including a pair of cables, each cable having a first end coupled to one of the pedals and a second end coupled to a spring which is in turn connected to the rear extent of the jet ski, wherein the cable is further connected to one of the brake flaps for lowering the brake flap upon the depression of the associated pedal.

3. The jet ski braking system as set forth in claim 2 wherein the pair of brake flaps are laterally spaced.

4. The jet ski braking system as set forth in claim 2 wherein the pair of brake pedals are laterally spaced.

5. The jet ski braking system as set forth in claim 2 wherein the interconnect assembly includes a spring for urging the brake flap upwards.

* * * * *